US007559104B1

(12) United States Patent
Kahrig

(10) Patent No.: US 7,559,104 B1
(45) Date of Patent: Jul. 14, 2009

(54) CHILD STABILIZER

(76) Inventor: Kevin M. Kahrig, 29 Meadow Rue Dr., Edwardsville, IL (US) 62025

( * ) Notice: Subject to any disclaimer, the term of this patent is extended or adjusted under 35 U.S.C. 154(b) by 0 days.

(21) Appl. No.: 12/132,773

(22) Filed: Jun. 4, 2008

(51) Int. Cl.
*A47D 13/08* (2006.01)

(52) U.S. Cl. ..... 5/655; 297/181; 446/72; 446/370

(58) Field of Classification Search ..... 5/655, 5/490, 636; 446/71, 72, 73, 369, 370; 297/181
See application file for complete search history.

(56) References Cited

U.S. PATENT DOCUMENTS 1,708,170 A * 4/1929 Dickins ..... 446/370
2,404,505 A * 7/1946 Knecht ..... 297/467
3,840,916 A * 10/1974 Jennings ..... 5/655
4,204,695 A 5/1980 Salzman
4,909,573 A * 3/1990 Barry et al. ..... 297/452.17
5,095,567 A * 3/1992 Kenoyer ..... 5/655
5,165,130 A 11/1992 Wendling
5,354,118 A * 10/1994 Barry ..... 297/181
5,519,906 A 5/1996 Fanto-Chan
5,941,599 A * 8/1999 Roberts ..... 297/115
5,996,152 A * 12/1999 Wilson ..... 5/655
6,354,665 B1 3/2002 Ross

* cited by examiner

*Primary Examiner*—Alexander Grosz
(74) *Attorney, Agent, or Firm*—Dale J. Ream

(57) ABSTRACT

A child stabilizer includes a frame portion having a first elongate frame member extending in a generally vertical direction and having upper and lower ends. The frame portion includes a second and third frame member extending outwardly from the lower end of the first frame member. A cushioned outer member encloses the frame portion and may include the appearance of a stuffed animal. The outer member may be removably coupled to a child such that the first frame member extends adjacent the child's spine and the second and third frame members extend outwardly behind the child to prevent the child from toppling backwards while sitting. The frame portion is sufficiently rigid to prevent the child from toppling backwards without buckling.

10 Claims, 7 Drawing Sheets

CHILD STABILIZER

BACKGROUND OF THE INVENTION

This invention relates generally to child development aids and, more particularly, to a child stabilizer device for preventing a child, when the device is attached thereto, from toppling backward or to the side and potentially being injured.

Infants generally develop balance skills between the ages of six to twelve months and begin to sit independently, crawl, and walk. Parents may be especially nervous during this period of development in that their young child may experience bumps, bruises, or even serious head trauma from falling backward or to the side when they lose their balance. To prevent this occurrence, parents often sit behind their child, keep a hand behind their back, or otherwise position pillows or the like all around the child.

Various devices have been proposed in the art for preventing the fall of an infant or toddler, especially from the seated position. More particularly, the devices proposed in U.S. Pat. Nos. 6,354,665, 5,165,130 and 3,840,916 are intended to surround a baby with protective padding so as to either contain the child or support the child in a seated position. Although assumably effective for their intended purposes, the devices proposed by these patents do not enable the child to crawl, walk, or otherwise be substantially mobile while still protecting the child from injury that may be caused from falling backward or side to side.

Therefore, it would be desirable to have a child stabilizer that may be removably coupled to an infant or toddler who has developed a degree of stability and mobility but still needs protection from falling backward or side to side. Further, it would be desirable to have a child stabilizer that may be removably coupled to a child and that maintains a functional position on his back whether sitting, standing, or moving from one location to another location. In addition, it would be desirable to have a child stabilizer that is aesthetically appealing and provides both physical and emotional comfort to the child so that the child desires to wear the child stabilizer.

SUMMARY OF THE INVENTION

Accordingly, a child stabilizer according to the present invention includes a frame portion having a first elongate frame member extending in a generally vertical direction and having upper and lower ends. The frame portion includes a second and third frame member extending outwardly from the lower end of the first frame member. A cushioned outer member encloses the frame portion and may include the appearance of a stuffed animal. The outer member may be removably coupled to a child such that the first frame member extends adjacent the child's spine and the second and third frame members extend outwardly behind the child to prevent the child from toppling backwards while sitting. The frame portion is sufficiently rigid to prevent the child from toppling backwards without buckling.

Therefore, a general object of this invention is to provide a child stabilizer for preventing a child, when the device is attached thereto, from toppling backward or to the side and potentially being injured.

Another object of this invention is to provide a child stabilizer, as aforesaid, that may be attached to an infant in a backpack manner and that does not inhibit the infant from movement such as crawling or walking.

Still another object of this invention is to provide a child stabilizer, as aforesaid, that is aesthetically appealing both to the child and to others.

Yet another object of this invention is to provide a child stabilizer, as aforesaid, that is rigid enough to stabilize a child from toppling over yet soft enough to be comfortable while attached to a child's body.

A further object of this invention is to provide a child stabilizer, as aforesaid, that is simple and inexpensive to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A child stabilizer will now be described in detail with reference to FIG. 1 through FIG. 7*b* of the accompanying drawings. More particularly, the child stabilizer 100 includes a frame portion 110 and a cushioned outer member 130.

Figure 4:
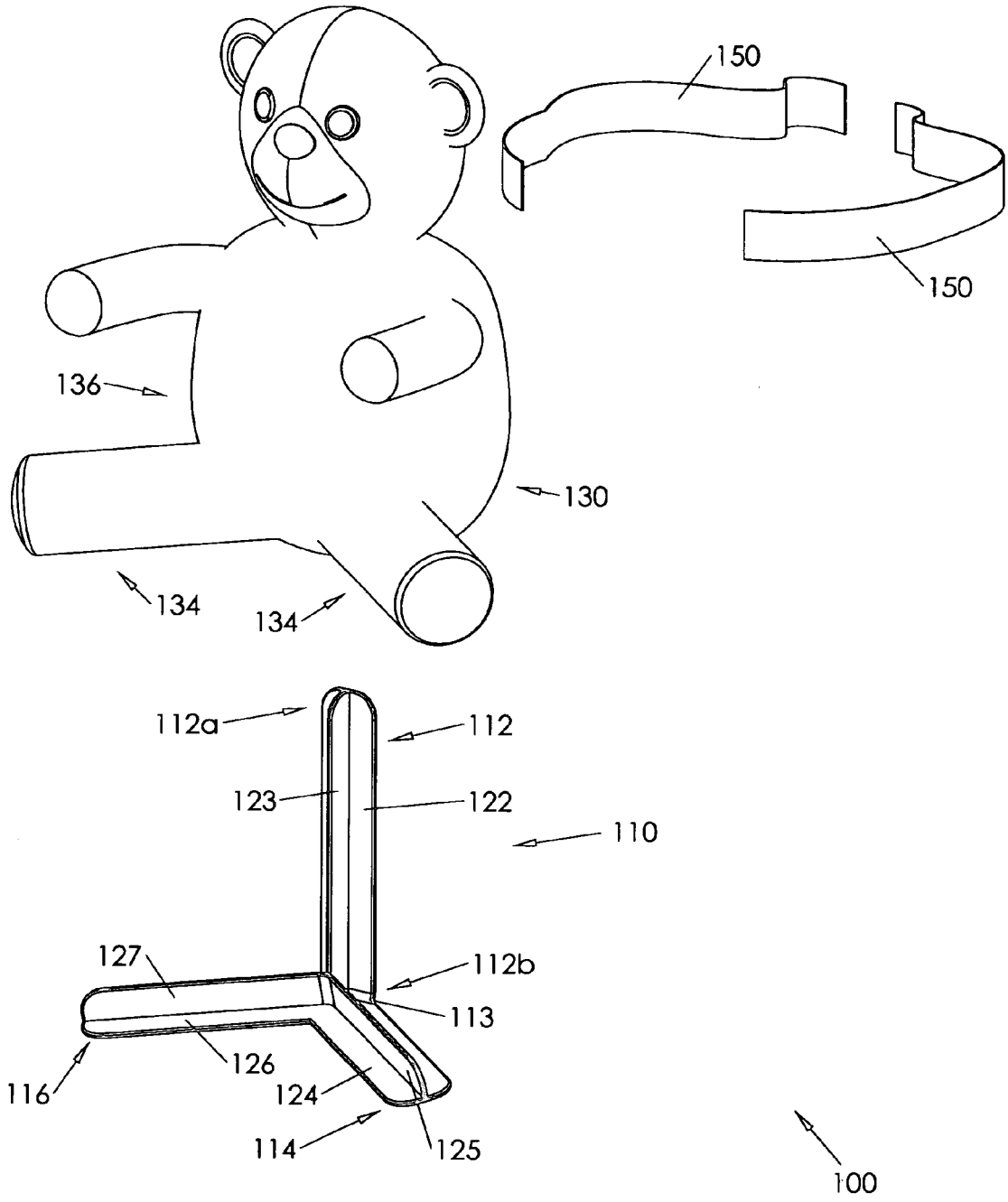
FIG. 4 is an exploded view of the child stabilizer as in FIG. 3.
Figure 5:
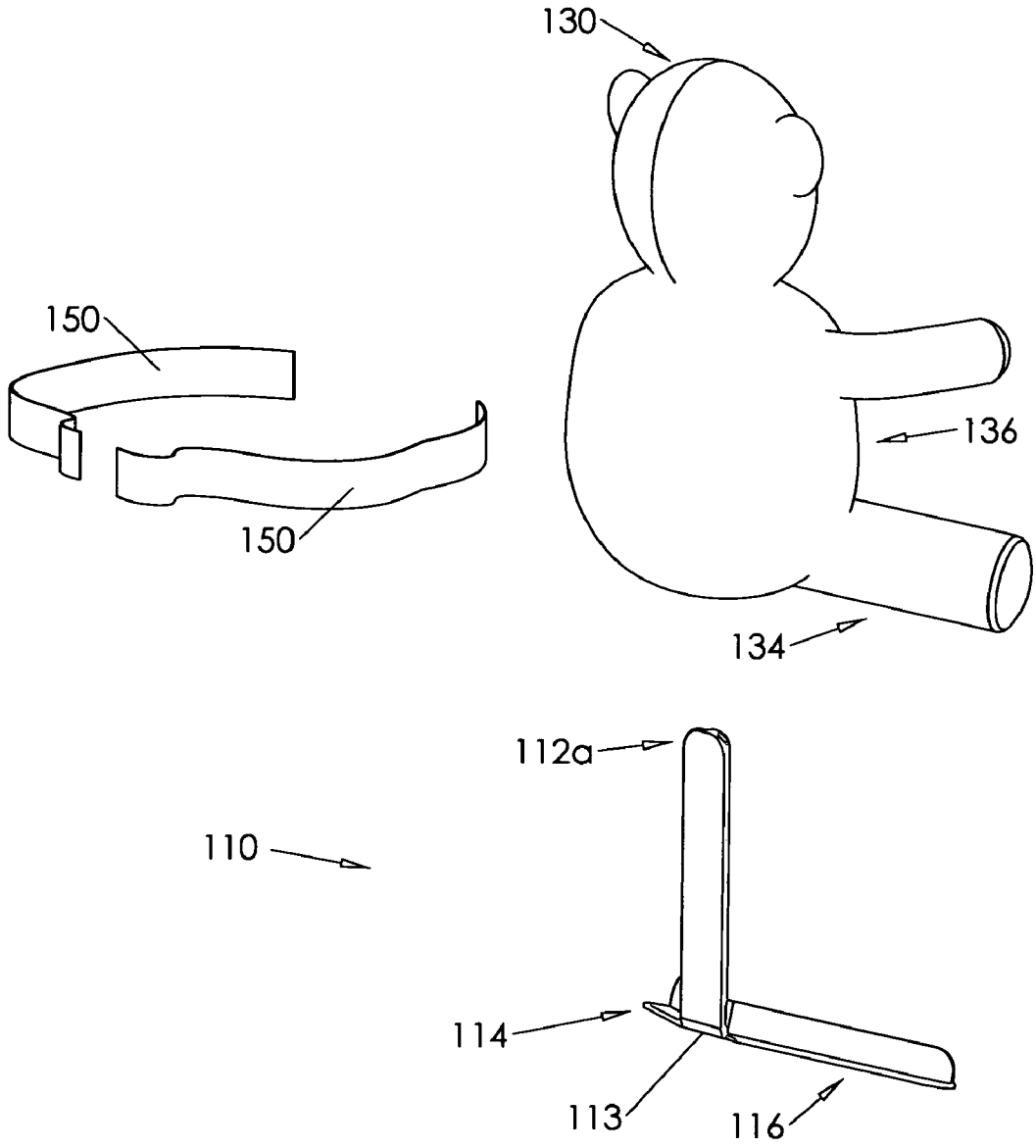
FIG. 5 is a reverse view of the child stabilizer as in FIG. 4.
Figure 6:
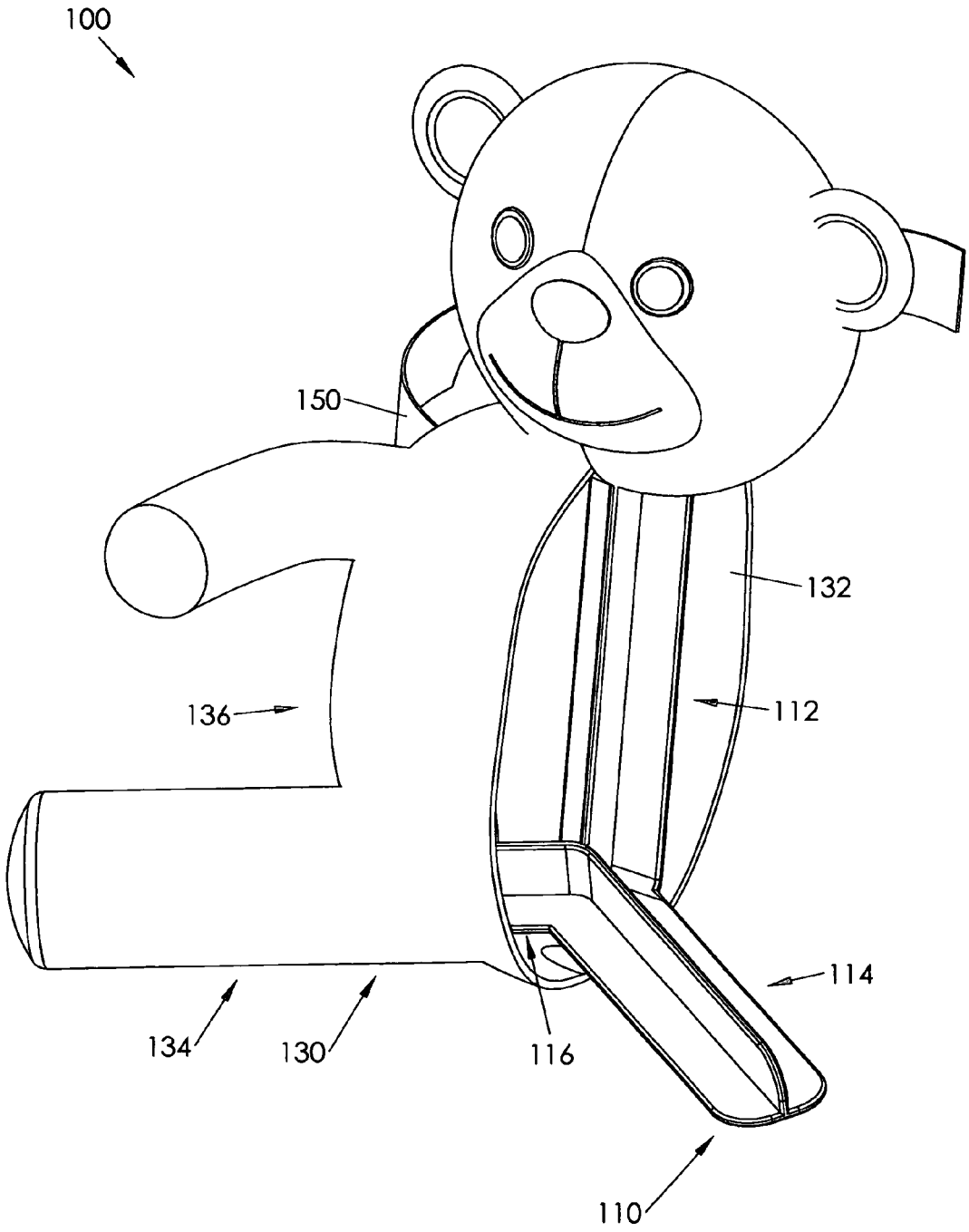
FIG. 6 is a fragmentary view of the child stabilizer as in FIG. 3.

As shown in FIGS. 4 through 6, the frame portion 110 includes first, second, and third frame members 112, 114, 116. The first elongate frame member 112 extends in a generally vertical direction and has upper and lower ends 112*a*, 112*b*. The second and third frame members 114, 116 extend outwardly from the lower end 112*b* of the first frame member 112. While the accompanying drawings show the second and third frame members 114, 116 extending from an extremity 113 of the lower end 112*b*, it should be understood that the second and third frame members 114, 116 may alternately extend from a point above the extremity 113 of the lower end 112*b*. The first, second, and third frame members 112, 114, 116 may be constructed of metal, plastic, and/or any other appropriate rigid material, and it may be preferable to use a lightweight material, such as aluminum or plastic. The corners of the frame portion 110 may be rounded for safety, manufacturing, or other reasons.

The cushioned outer member 130 encloses the frame portion 110 (i.e., the first, second, and third frame members 112, 114, 116). The cushioned outer member 130 may include, for example, a cloth exterior 132 and foam, stuffing, and/or another cushioning material inside the cloth exterior 132. In various embodiments, the outer member 130 may be shaped to have at least two legs 134 and a torso 136 to resemble an animal (e.g., a bear, a person, a dog, etc.). The outer member 130 throughout the drawings has a teddy bear configuration to resemble a bear, for example. As shown in FIG. 6, the first frame member 112 may be positioned in the torso 136, the second frame member 114 may be positioned in one leg 134, and the third frame member 116 may be positioned in another leg 134. The outer member 130 is preferably sufficiently durable to keep the frame portion 110 from piercing the outer member 130 during normal use.

Figure 1:
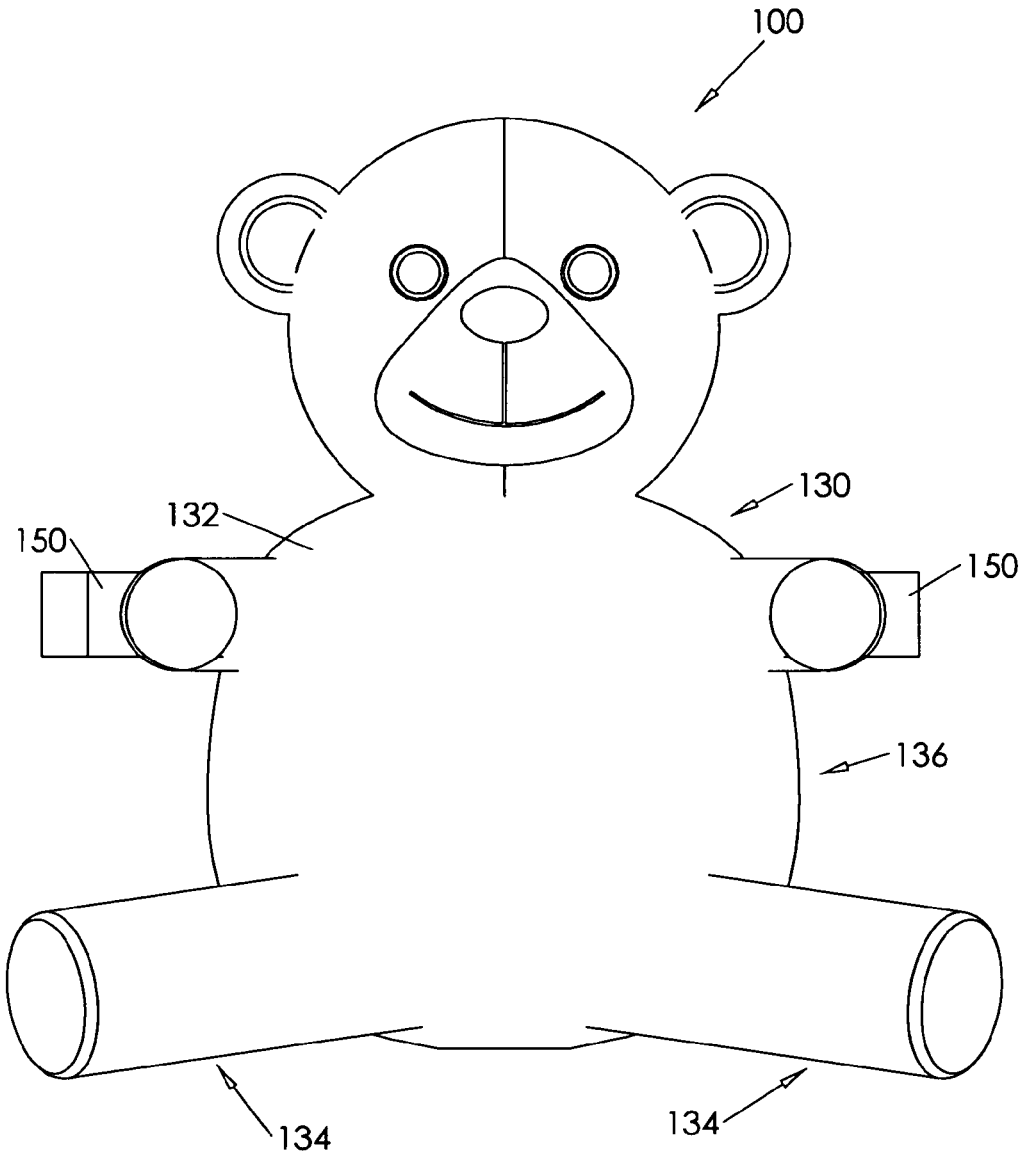
FIG. 1 is a front view of a child stabilizer according to a preferred embodiment of the present invention.
Figure 2:
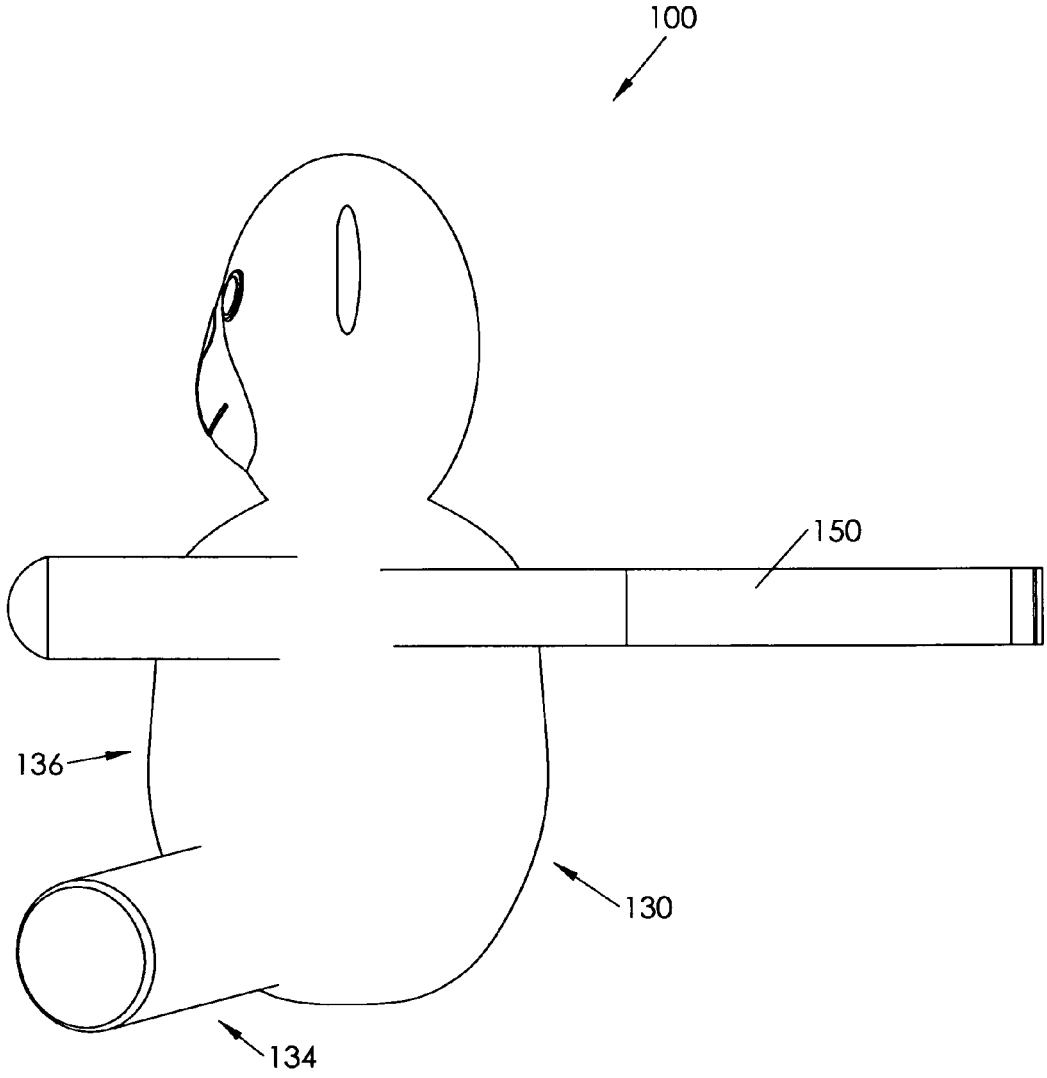
FIG. 2 is a side view of the child stabilizer as in FIG. 1.
Figure 3:
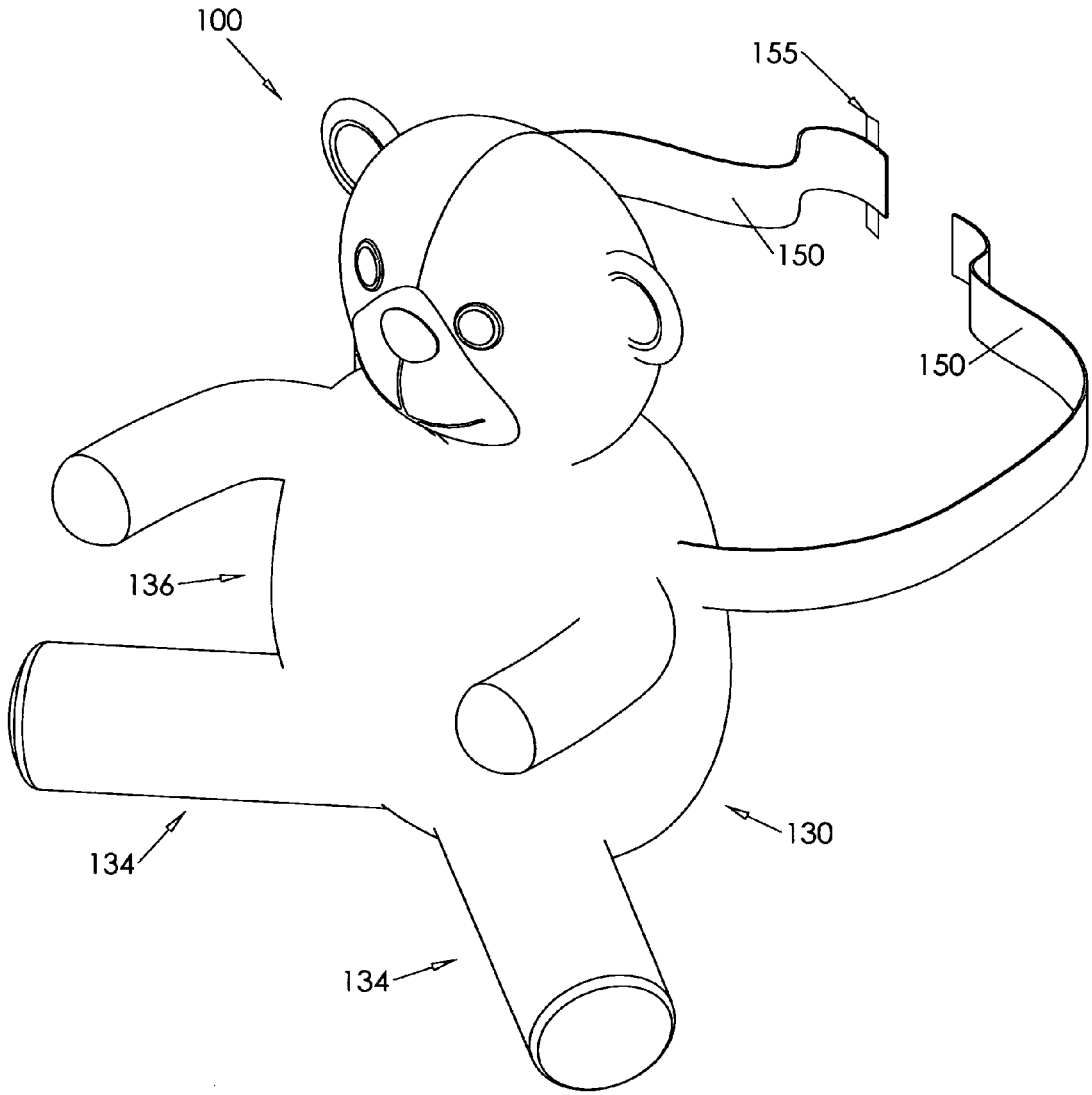
FIG. 3 is an elevated perspective view of the child stabilizer as in FIG. 1.

Means are included for operatively coupling the outer member 130 to a child such that the first frame member 112 extends adjacent the child's spine and the second and third frame members 114, 116 extend outwardly behind the child to prevent the child from toppling backwards while sitting. For example, one or more strap 150 may be coupled to the outer member 130 and/or the first frame member 110 to operatively couple the outer member 130 to the child's back in such a manner. In one embodiment, two straps 150 are used and a fastener 155 (e.g., a buckle, a hook and loop fastener, a snap, a zipper, etc.) is included to couple the two straps 150 together (FIG. 3). As used herein, the number of straps 150 are counted by the number of strap elements that extend from the outer member 130. In other words, even if the straps 150 shown in FIG. 3 were connected inside the outer member 130, there would still be two straps 150.

The first frame member 112, the second frame member 114, the third frame member 116, the cushioned outer member 130, and the means for coupling the outer member 130 to a child may be collectively configured to allow the child to crawl and sit without obstruction while the outer member 130 is operatively coupled to the child's back. In other words, these elements may be sized and shaped to allow a child using the child stabilizer 100 to crawl or sit without impediment.

Figure 7A:
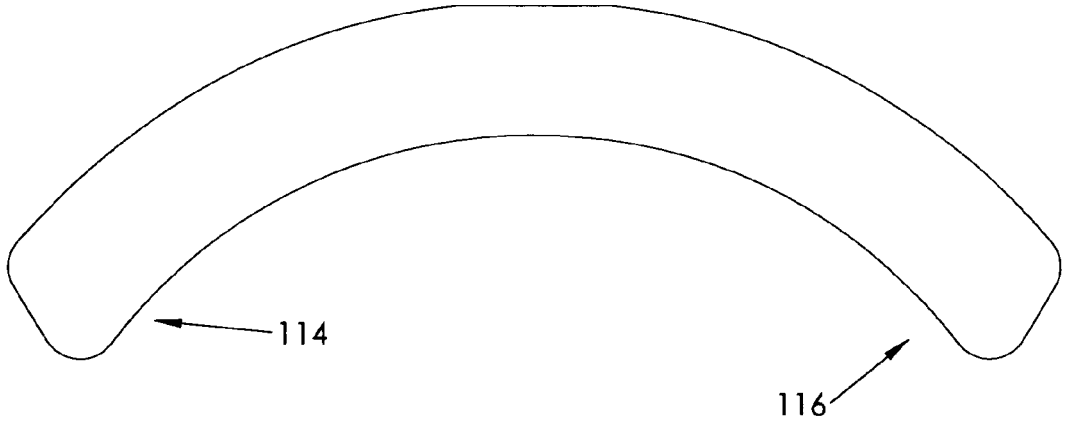
FIG. 7*a* is an isolated view showing an alternative configuration of a portion of the frame.
Figure 7B:
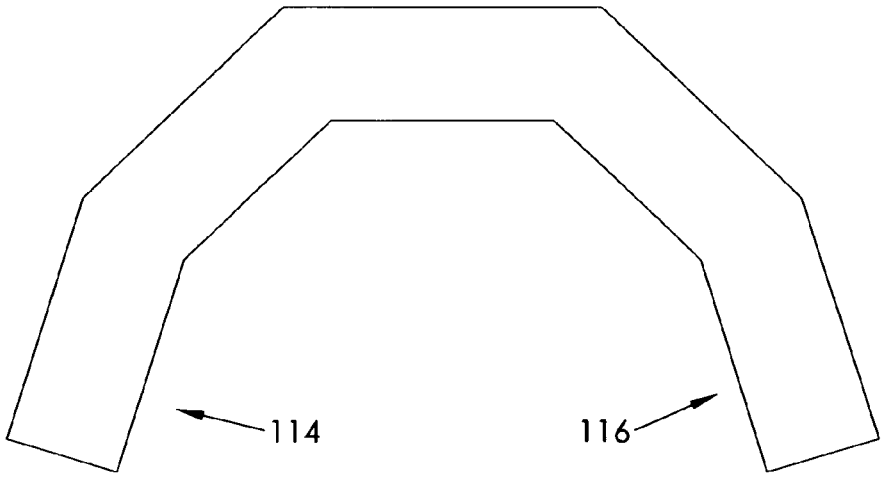
FIG. 7*b* is another isolated view showing still another alternative configuration of a portion of the frame.

Returning specifically to the frame portion 110, the first, second, and third frame members 112, 114, 116 may be sufficiently rigid to prevent the child from toppling backwards without buckling (i.e., without failure of the first, second, or third frame member 112, 114, 116). The first, second, and third frame members 112, 114, 116 may respectively be generally linear, as shown in FIG. 4, or the second and third frame members 114, 116 in particular may be curved or otherwise offset, as shown in FIGS. 7*a* and 7*b*, for example. The frame portion 110 may be generally symmetrical about the first frame member 112, and the second and third frame members 114, 116 may each be offset from the first frame member 112 at an angle between about 45 degrees and about 120 degrees. The second frame member 114 may be offset from the third frame member 116 at an angle between about 45 degrees and about 150 degrees.

In one embodiment, as shown in FIG. 4, the first frame member 112 has a planar face 122 extending toward the child's spine when the outer member 130 is operatively coupled to the child, the second frame member 114 has a planar face 124, the third frame member 116 has a planar face 126, and the planar faces 122, 124, 126 join one another. A flange 123 may extend at least partially along the first frame member planar face 122, a flange 125 may extend at least partially along the second frame member planar face 124, and a flange 127 may extend at least partially along the third frame member planar face 126. The flanges 123, 125, 127 may join one another, as shown in FIG. 4. One or more of the flanges 123, 125, 127 may act to add rigidity to the respective planar faces 122, 124, 126 and/or to allow the outer member 130 to more easily remain generally fixed relative to the frame portion 110, or the flanges 123, 125, 127 may be beneficial for other reasons.

In use, the child stabilizer 100 may be coupled to a child. More particularly, outer member 130 may be positioned so that the first frame member 112 extends adjacent the child's spine and the second and third frame members 114, 116 extend outwardly behind the child, and the strap(s) 150 or other means may be used to operatively couple the outer member 130 to the child. Due to the configuration of the various elements (as set forth above), the child may crawl or sit without obstruction from the child stabilizer 100. If the child starts to fall backwards or to the side while sitting, operative interaction between the second frame member 114 and/or the third frame member 116 with the ground may keep the child from falling and allow the child to regain his balance. By keeping the child from falling, various injuries (including substantial injuries to the child's head) may be avoided.

It is understood that while certain forms of this invention have been illustrated and described, it is not limited thereto except insofar as such limitations are included in the following claims and allowable functional equivalents thereof.

The invention claimed is:

1. A child stabilizer, comprising:

a first elongate, rigid, generally linear frame member extending in a generally vertical direction and having upper and lower ends;

second and third elongate, rigid, generally linear frame members extending outwardly from said lower end of said first frame member in a generally symmetrical orientation about said first frame member and defining an open area therebetween, of a sufficient size to accommodate a seated child, said second frame member being offset from said first frame member at an angle between 45 degrees and 120 degrees, said second frame member being offset from said third frame member at an angle between 45 degrees and 150 degrees;

a cushioned outer member enclosing said first, second, and third frame members; and at least one strap coupled to at least one of said outer member and said first frame member to operatively couple said outer member to a child's back such that said first frame member extends adjacent said child's back and said second and third frame members extend outwardly behind said child to prevent said child from toppling backwards while sitting in the open area defined between said second and third elongate frame members, wherein said first frame member, said second frame member, said third frame member, said cushioned outer member, and said strap are collectively configured to allow a child to crawl and sit without obstruction while said outer member is operatively coupled to the child's back.

2. The child stabilizer of claim 1, wherein said first, second, and third frame members are sufficiently rigid to prevent said child from toppling backwards without buckling.

3. The child stabilizer of claim 1, wherein:

two straps are coupled to at least one of said outer member and said first frame member to operatively couple said outer member to a child's back such that said first frame member extends adjacent said child's back and said second and third frame members extend outwardly behind said child to prevent said child from toppling backwards while sitting; and at least one said strap includes a fastener to couple said two straps together.

4. The child stabilizer of claim 1, wherein:

said first frame member is constructed of at least one of metal and plastic;

said second frame member is constructed of at least one of metal and plastic; and said third frame member is constructed of at least one of metal and plastic.

5. The child stabilizer of claim 1, wherein:

said outer member is shaped to have at least two legs and a torso to resemble an animal;

said first frame member is positioned in said torso;

said second frame member is positioned in one said leg; and said third frame member is positioned in another said leg.

6. The child stabilizer of claim 1, wherein:

said first, second, and third frame members are sufficiently rigid to prevent said child from toppling backwards without buckling;

two straps are coupled to at least one of said outer member and said first frame member to operatively couple said outer member to a child's back such that said first frame member extends adjacent said child's back and said second and third frame members extend outwardly behind said child to prevent said child from toppling backwards while sitting;

at least one said strap includes a fastener to couple said two straps together;

said outer member is shaped to have at least two legs and a torso to resemble an animal;

said first frame member is positioned in said torso;

said second frame member is positioned in one said leg; and said third frame member is positioned in another said leg.

7. A child stabilizer, comprising:

a frame portion comprising:

a first elongate, rigid, generally linear frame member extending in a generally vertical direction and having upper and lower ends; and second and third elongate, rigid, generally linear frame members extending outwardly from said lower end of said first frame member;

a cushioned outer member enclosing said frame portion in a generally symmetrical orientation about said first frame member and defining an open area therebetween, of a sufficient size to accommodate a seated child, said second frame member being offset from said first frame member at an angle between 45 degrees and 120 degrees, said second frame member being offset from said third frame member at an angle between 45 degrees and 150 degrees;

means for operatively coupling said outer member to a child such that said first frame member extends adjacent said child's spine and said second and third frame members extend outwardly behind said child to prevent said child from toppling backwards while sitting in the open area defined between said second and third elongate frame members, wherein said first frame member, said second frame member, said third frame member, said cushioned outer member, and said strap are collectively configured to allow a child to crawl and sit without obstruction while said outer member is operatively coupled to the child's back;

and wherein said frame portion is sufficiently rigid to prevent said child from toppling backwards without buckling.

8. The child stabilizer of claim 7, wherein:

said outer member is shaped to have at least two legs and a torso to resemble an animal;

said first frame member is positioned in said torso;

said second frame member is positioned in one said leg; and said third frame member is positioned in another said leg.

9. A child stabilizer, comprising:

a first elongate, rigid, generally linear frame member extending in a generally vertical direction and having upper and lower ends;

second and third elongate, rigid, generally linear frame members extending outwardly from said lower end of said first frame member in a generally symmetrical orientation about said first frame member and defining an open area therebetween, of a sufficient size to accommodate a seated child, said second frame member being offset from said first frame member at an angle between 45 degrees and 120 degrees, said second frame member being offset from said third frame member at an angle between 45 degrees and 150 degrees;

a cushioned outer member enclosing said first, second, and third frame members; and means for operatively coupling said outer member to a child such that said first frame member extends adjacent said child's spine and said second and third frame members extend outwardly behind said child to prevent said child from toppling backwards while sitting in the open area defined between said second and third elongate frame members, wherein said first frame member, said second frame member, said third frame member, said cushioned outer member, and said strap are collectively configured to allow a child to crawl and sit without obstruction while said outer member is operatively coupled to the child's back;

wherein said first frame member has a planar face extending toward said child's spine when said outer member is operatively coupled to said child;

wherein said first frame member has a flange extending at least partially along said first frame member planar face;

wherein said second frame member has a planar face and a flange extending at least partially along said second frame member planar face;

wherein said third frame member has a planar face and a flange extending at least partially along said third frame member planar face; and wherein said first frame member planar face joins said second frame member planar face and said third frame member planar face.

10. The child stabilizer of claim 9, wherein said first frame member flange joins said second frame member flange and said third frame member flange.

* * * * *